United States Patent [19]

Trovò

[11] Patent Number: 5,035,347

[45] Date of Patent: Jul. 30, 1991

[54] DEVICE FOR SQUEEZING TUBES CONTAINING A PASTE

[76] Inventor: Federico Trovò, P.O. Box 905, 35122 Padova, Italy

[21] Appl. No.: 300,567

[22] Filed: Jan. 23, 1989

[51] Int. Cl.[5] ..... B65D 35/30; B65D 35/24; B65D 35/56

[52] U.S. Cl. ..... 222/95; 222/93; 222/105

[58] Field of Search ..... 222/93, 95, 101, 102, 222/105

[56] References Cited

U.S. PATENT DOCUMENTS

| | | | |
|---|---|---|---|
| 1,965,271 | 7/1934 | Wharton | 222/95 |
| 2,613,853 | 10/1952 | Halvorsen | 222/105 |
| 2,795,356 | 6/1957 | Tschumy | 222/95 |
| 3,087,653 | 4/1963 | Nolin | 222/105 |
| 3,172,569 | 3/1965 | Wolford | 222/105 |
| 4,629,095 | 12/1986 | Smith | 222/105 |

FOREIGN PATENT DOCUMENTS

| | | | |
|---|---|---|---|
| 2543665 | 4/1976 | Fed. Rep. of Germany | 222/95 |
| 61592 | 4/1951 | France | 222/95 |
| 1179121 | 7/1957 | France | 222/95 |

*Primary Examiner*—H. Grant Skaggs
*Assistant Examiner*—Steve Reiss

[57] ABSTRACT

The present invention consists of an improvement device for the squeezing of tubes containing paste, in particular toothpaste. The device in question consists of a tubular casing which can be affixed to the wall, inside which slides a piston fitted with a suitably shaped slit, into which the closed end of the tube containing the paste is inserted. The open end of the tube rests on the base of the said casing and the paste flows out through a hole present on the same base. The piston is pushed forwards by a threaded rod topped by a knob. As the piston slides, the sides of the slit produce, thanks to their particular shape, pressure on the tube which forces out the paste.

1 Claim, 4 Drawing Sheets

FIG. 4
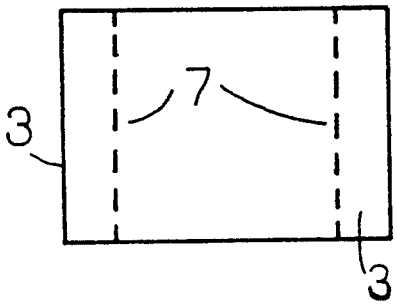
FIG. 5
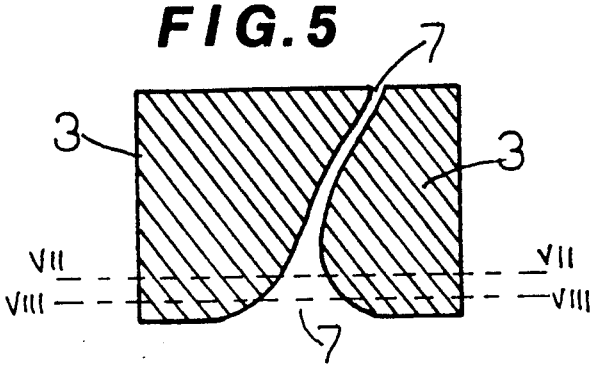
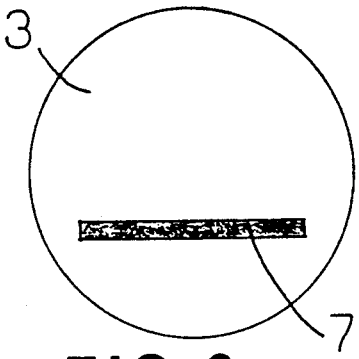
FIG. 6
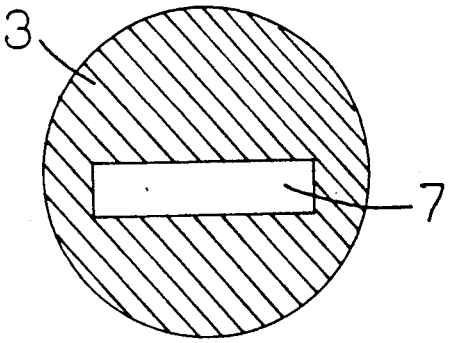
FIG. 7
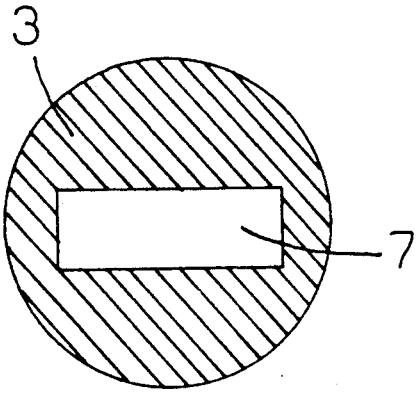
FIG. 8
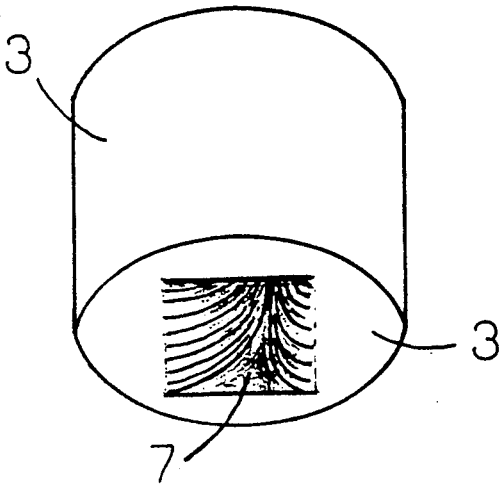
FIG. 9

DEVICE FOR SQUEEZING TUBES CONTAINING A PASTE

This particular invention concerns a device for the squeezing of tubes containing a paste such as toothpaste. Such device serves principally to limit the manual work involved and to use the tupe progressively and completely.

It is suitable for tubes of any size.

It is a simple, resistant and economical device.

It can easily be produced industrially.

The device under consideration, as claimed, consists of a tubular casing, within which slides a piston having a particularly shaped slit, into which the closed end of the tube containing the paste fits, the open end of the said tube resting on the base of the said casing, the opening protruding through a hole in the same base. The device is also fitted with a means for pushing the piston, for example a small threaded rod topped by a screw.

The casing can additionally have an appendage for fixing the device to a wall, a lower protective cap, a control window and a toothbrush holder.

The principle of the device invented will become clearer when the detailed description has been read together with the designs, included to illustrate its indicated but not limited shape which show how well the device can be realized. The enclosed designs include:

FIG. 4 is a view of a piston suitable for this device;

FIG. 5 is a section view of this piston;

FIG. 6 is the same piston seen from above;

FIG. 7 is a section view of the piston along the plane VII—VII;

FIG. 8 is a section view of the piston along the plane VIII—VIII;

FIG. 9 is a prospective view of the piston seen from below of the preceding figures.

Figure 1:
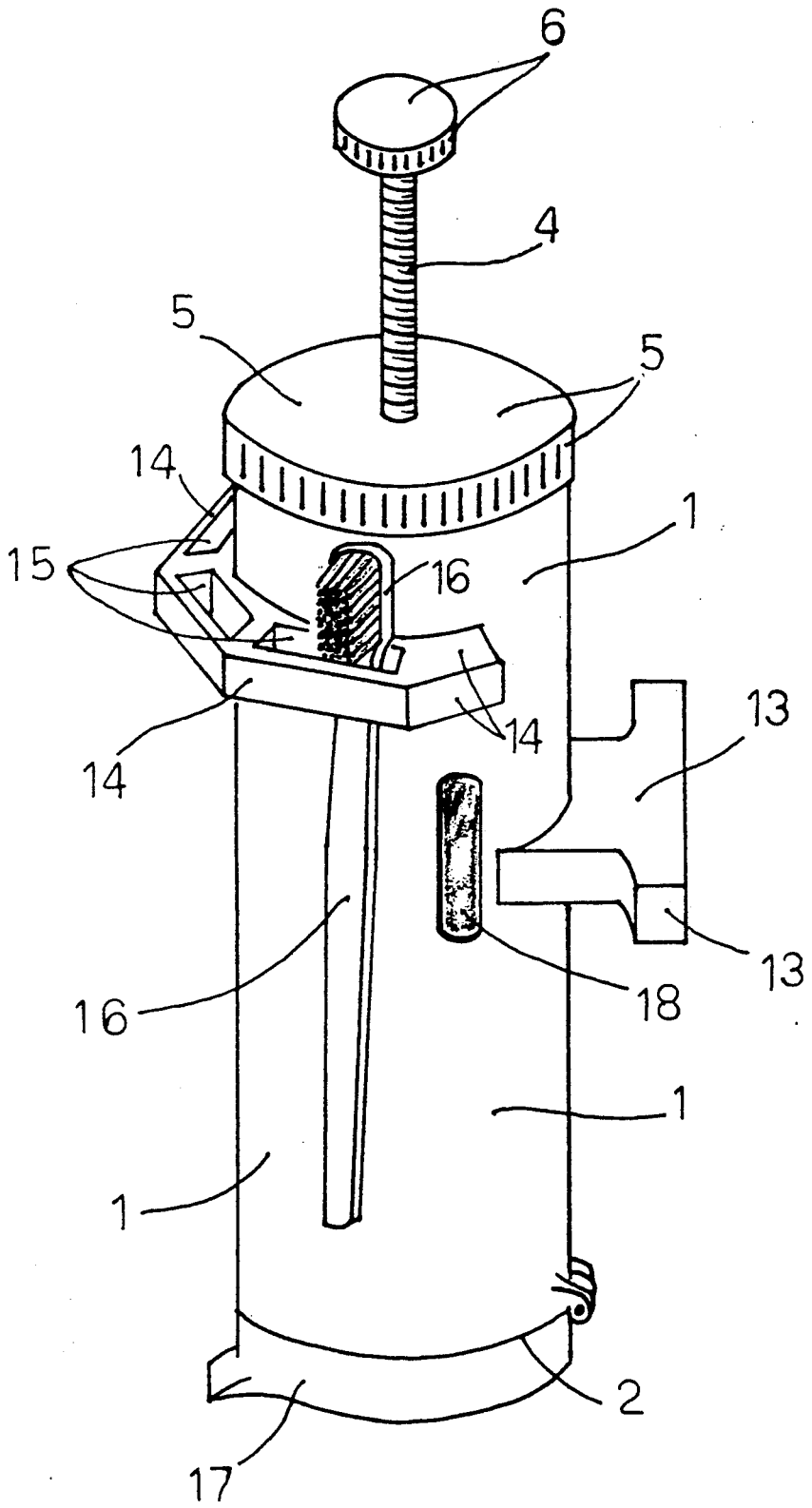
FIG. 1 is a lateral perspective of this entire device.
Figure 2:
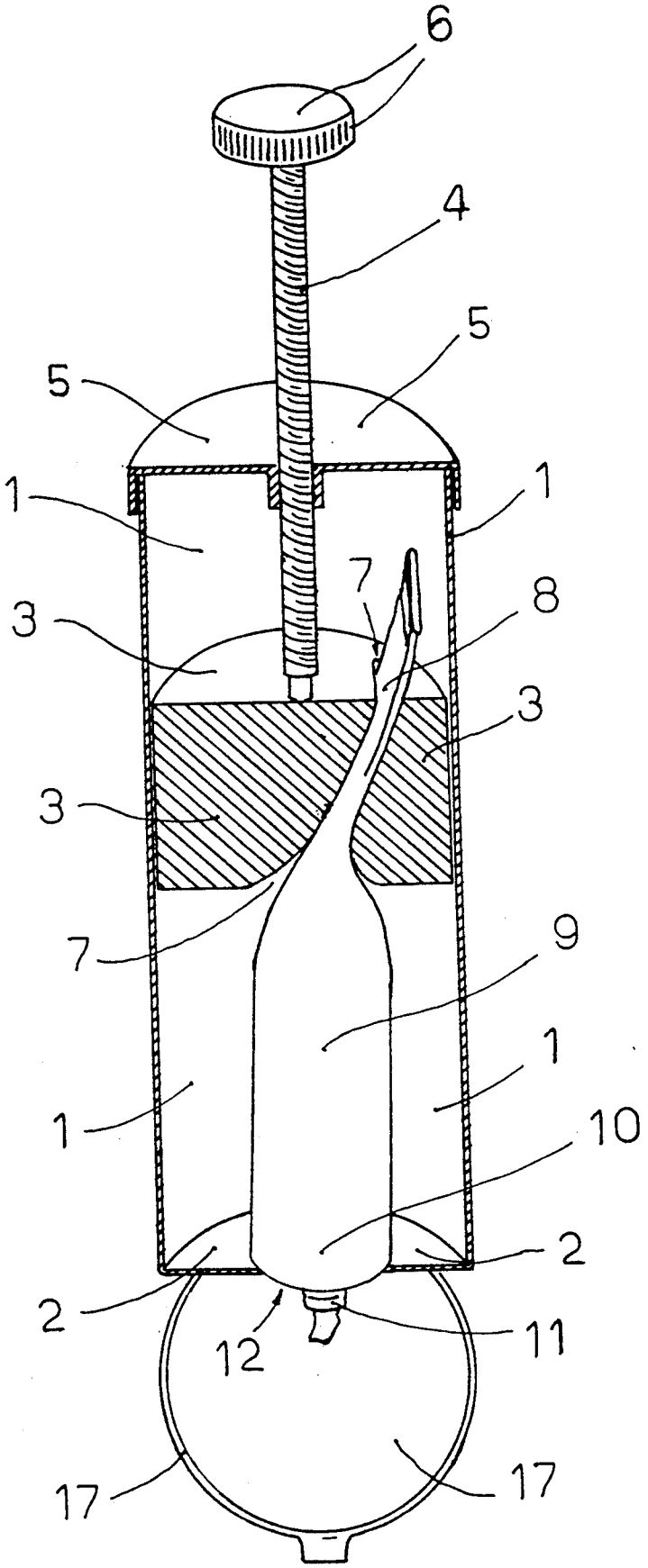
FIG. 2 is a section view of the same device.
Figure 3:
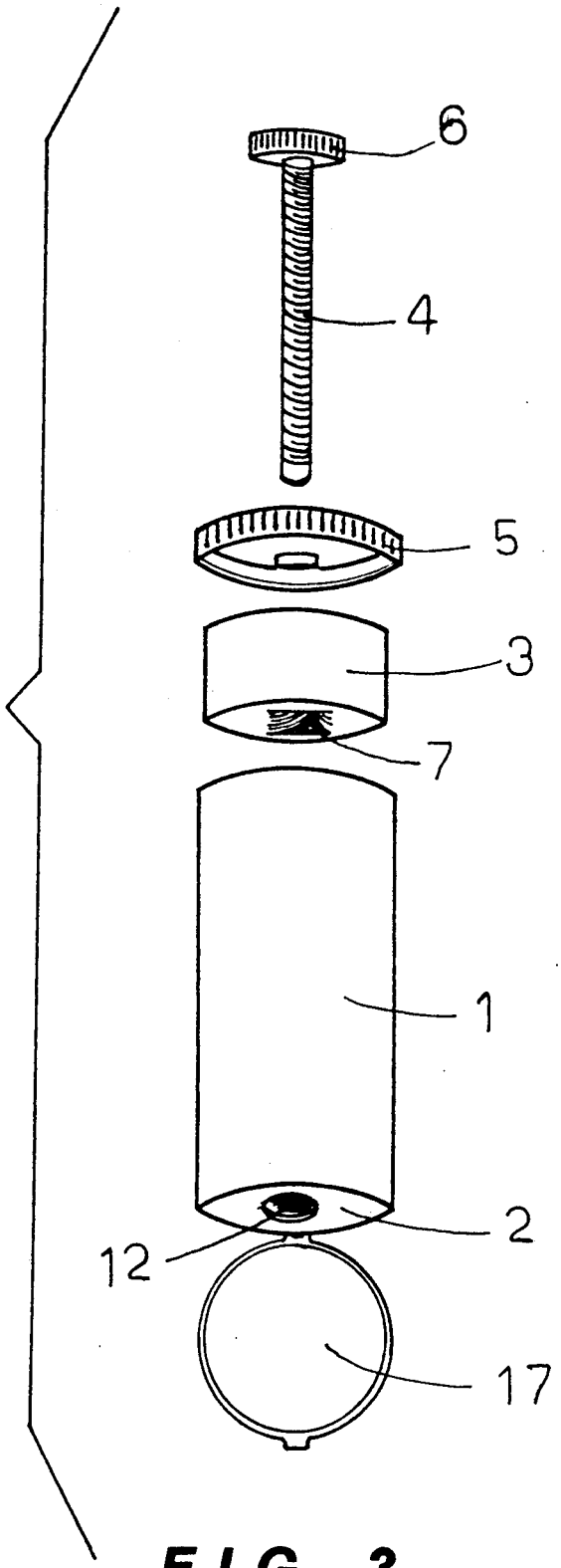
FIG. 3 is a blow-up of its sprinciple parts.

The device illustrated in the figures consists of a cylindrical tubular casing (1) with a closed base (2) in which the piston (3) can slide pushed towards the base (2) by a small threaded rod (4) pivoted in the centre of a circular cap (5) screwed on to the casing (1).

The small threaded rod (4) is fitted with a manipulating knob (6) at the extreme end protruding from the casing (1).

The piston (3) is fitted longitudinally with a slit (7) having a shape similar to a curved funnel, into which the closed end (8) of a tube (9) is inserted, the open end (10) resting on the base (2) of the casing (1).

The mouth of the tube (9) protrudes from a hole (12) drilled into the base (2).

Externally, the casing (1) is fitted with an appendage (13) for fixing it to a wall and with a holder (14) having spaces (15) for toothbrushes (16). On the exterior of the base (2) a second cover (17) is hinged to protect the end (11) of the tube (9). The casing (1) is also fitted with a control window (18) which allows for any necessary corrections to the piston on loading.

The device is loaded as follows: the tube (9) is put upside down in the casing (1) with the end (11) protruding from the hole (12); then the piston (3) is introduced taking care that the slit (7) fits over the closed end (8) of the tube (9); finally screw down the top (5) which supports the rod (4).

Obviously all the sizes and materials used can be of any type, depending on the need.

Moreover, all the elements can be substituted for others which are equivalent technically; in fact the device can be realized in various ways and shapes, all of which fall into the same category of this invention.

We claim:

1. A device for the squeezing of tubes having one closed end and containing paste comprising a tubular casing in which slides a piston having the same cross-sectional shape as the tubular casing, said casing having an upper closure provided with a threaded central bore, said piston having spaced apart lower first and upper second surfaces and tranversed by a rectilinear shaped slit extending between said surfaces and having an insertion end formed in the shape of a curved asymmetrical funnel, whereby the closed end of a tube of paste can be inserted into the insertion end of the slit formed substantially in the center of the first surface, the paste in the tube being expelled be exerting manual pressure on said piston by means of a threaded rod connected coaxially to the second surface of the piston and being mounted in the upper closure bore of the casing closure, and the slit being arranged such that as said paste is expelled, said closed end of the tube protrudes from said second surface through an exit end of said slit offset from the center of the second surface of the piston, the paste exuding from an open end of the tube sitting on an aperture cut into a base of the casing, and said casing being fitted with an open, oblong window cut vertically into the casing, into which a finger or other object can be inserted to correct the position of the piston at the time of inserting the tube into the insertion end of the slit or in the event of the malfunctioning of the device.

* * * * *